US006138485A

United States Patent [19]

Fuss et al.

[11] Patent Number: 6,138,485

[45] Date of Patent: Oct. 31, 2000

[54] SAFETY LOCK

[75] Inventors: Fritz Helmut Fuss; Gerhard Gonser, both of Albstadt, Germany

[73] Assignee: eff-eff Fritz Fuss GmbH & Co. Kommanditgesellschaft auf Aktien, Albstadt-Ebingen, Germany

[21] Appl. No.: 09/022,402

[22] Filed: Feb. 12, 1998

[30] Foreign Application Priority Data

Feb. 26, 1997 [DE] Germany ..... 197 07 762

[51] Int. Cl.[7] ..... E05B 59/00

[52] U.S. Cl. ..... 70/107; 70/278.7; 70/277; 70/218

[58] Field of Search ..... 70/279.1, 218, 70/219, 220, 278.3, 278.7, 283, 283.1, 107, 110, 111, 277

[56] References Cited

U.S. PATENT DOCUMENTS

| | | | |
|---|---|---|---|
| 3,733,861 | 5/1973 | Lester | 70/277 |
| 3,873,892 | 3/1975 | DeHling et al. | 70/276 |
| 4,606,203 | 8/1986 | Esser | 70/107 |
| 4,762,212 | 8/1988 | Fish et al. | 70/283 |
| 4,809,526 | 3/1989 | Shen | 70/107 |
| 5,005,393 | 4/1991 | Ewalds et al. | 70/277 |
| 5,044,184 | 9/1991 | Herbers et al. | 70/107 |
| 5,083,448 | 1/1992 | Kärkkäinen et al. | 70/110 |
| 5,482,334 | 1/1996 | Hötzl | 70/107 |
| 5,513,505 | 5/1996 | Dancs | 70/107 |

FOREIGN PATENT DOCUMENTS

| | | | |
|---|---|---|---|
| 0094592 | 11/1983 | European Pat. Off. | 70/283 |
| 3836694 | 5/1990 | Germany | 70/107 |
| 44 07 244 | 8/1995 | Germany . | |
| 2206638 | 1/1989 | United Kingdom | 70/283 |

*Primary Examiner*—Darnell Boucher
*Attorney, Agent, or Firm*—Oblon, Spivak, McClelland, Maier & Neustadt, P.C.

[57] ABSTRACT

A safety lock, particularly a self-locking lock, including at least one lock catch and a bolt operable by a lock cylinder and a split latch nut. For creating a particularly inexpensively manufacturable and relatively narrow safety lock, a coupling device of the lock is provided with two congruent racks which have a panic or freewheel function. The racks are superimposed and mesh with the teeth of the inner and outer nut. An electromagnetic coupling is achieved with the aid of a coupling lever, which is fixable to each rack directly or indirectly subjects to the function of the particular rack and engageable with a detent of the racks.

11 Claims, 7 Drawing Sheets

SAFETY LOCK

BACKGROUND OF THE INVENTION

1. Field of the Invention

The invention relates to a safety lock with at least one lock catch and a bolt, which is operable by means of a lock cylinder and a split latch nut, the split latch nut having an inner nut with a panic function and an outer nut with a freewheel function, which can be coupled by means of an electromagnetic coupling device.

2. Discussion of the Background

A lock according to the preamble is also known from DE 44 07 244 C1. A bolt of this lock is operable by means of a latch nut or a lock cylinder. The latch nut is in two parts in order to ensure in the case of a panic situation that opening by means of an inner door knob. An inner or panic nut is connected in non-rotary manner to a latch lever, which by means of drivers can move a lock catch and by means of a pivot lever a bolt from an extended closed position into a retracted open position. An outer nut connected in non-rotary manner to the outside door knob can be connected by means of an electromagnetically operable coupling to the inner nut. The coupling device comprises a spring-tensioned detent, as well as an electromagnet armature used for detent actuation purposes. If the electromagnet is unenergized, the levers of the inner and outer nut are decoupled, whereas when the electromagnet is energized the detent leads through the attracted armature to the coupling of the inner and outer nut lever.

The known coupling device is advantageous for locks subject to no significant limitations with regards to their dimensions and in particular their width. For framed doors having a relatively narrow area for the installation of a lock and which must also comply with the insurance law regulations concerning the bolt move out in a locking position, the known coupling device is less suitable as a result of its dimensions. In addition, differently constructed nut levers are used, so that a more rational manufacture and installation is only possible to a limited extent.

SUMMARY OF THE INVENTION

The object of the invention is to provide a safety lock which, with respect to inexpensive manufacture and space-saving dimensions of the coupling device and the mechanism cooperating therewith, has a particularly efficient construction and is in particular suitable for doors having relatively narrow frame areas.

According to the invention this object is achieved in that as the coupling device are provided two racks, one rack as the inner or panic rack engaging with the inner nut and one rack as the outer or freewheel rack with the outer nut by means of meshing teeth, and that a coupling lever is provided, which can be fixed to one of the racks and is constructed for coupling engagement on the in each case other rack.

An essential idea of the invention is to couple together by means of in each case one rack an inner nut with a panic function and an outer nut with a freewheel function. The two congruently constructed racks interconnected by means of meshing teeth with the inner/panic nut or with the outer/freewheel nut are electromagnetically coupled together. Advantageously, the coupling of the freewheel rack and the panic rack takes place with the aid of a specific coupling lever, which is directly or indirectly fixed to a rack and, adjusted, e.g. pivoted by means of an electromagnet so as to be able to pass into a coupling position with a coupling element, e.g. a coupling nose of the panic rack.

AppropriateLy the coupling lever is articulated to an armature plate, which is fixable to a rack. For the coupling device use is made of homologously or congruently constructed racks and, an inexpensive manufacture thereof is possible, e.g. in a stamping and following bending process.

A further advantage is the space-saving construction of the racks, which advantageously directly engage on an inside housing wall and are only widened in plate-like manner in the area of the latch nut halves.

Together with the elongated construction of the racks, an advantageous arrangement of the armature plate in an upper area on an end face of the particular rack facing a lock face plate leads to a particularly limited space requirement on the part of the coupling device. A safety lock equipped therewith can be given an overall relatively narrow construction and can be installed in doors with a depth-limited reception area for the lock.

A limited space requirement is also achieved through the use of a gear drive and the integrated arrangement of the meshing teeth of the nut halves and the racks for the transmission of the rotary movement of the inner and outer nut to the particular rack. On operating the panic nut, e.g. the panic rack is moved linearly and towards the lower housing side wherein by means of control edges or cams and drivers at least one bolt and a lock catch are directly or indirectly moved from a closed position into an open position.

The design of the coupling lever or armature plate, which can fundamentally be fixed, as desired, to one of the two racks, also has an advantageous effect on the manufacturing and installation costs of the safety lock. The fixing to a side of the particular rack facing a housing bottom or a housing cover essentially depends on the function of the rack as a panic or inner rack or freewheel or outer rack, the arrangement being determined by the lock construction, i.e. the door stop, opening direction and panic side.

The congruent racks can advantageously be provided either as a panic or freewheel rack and can be guided either on the housing bottom or on the safety lock cover. For guidance purposes each rack appropriately has an upper elongated hole for receiving a fastening bolt fixed to the bottom or cover and a recess in the vicinity of the nut reception opening for a further driving pin fixed on the bottom or cover side.

The teeth of a rack are in each case constructed on an inner edge of the nut reception opening and engage with the teeth of the adjacent inner or outer nut extending into the nut reception opening. A compression spring is in each case provided on a lower, particularly narrow rack area and brings about a resetting to the starting position of the actuated nut latch.

BRIEF DESCRIPTION OF THE DRAWINGS

The inventor is described in greater detail hereinafter relative to the highly diagrammatic drawings, wherein show.

DESCRIPTION OF THE PREFERRED EMBODIMENTS

Figure 1:
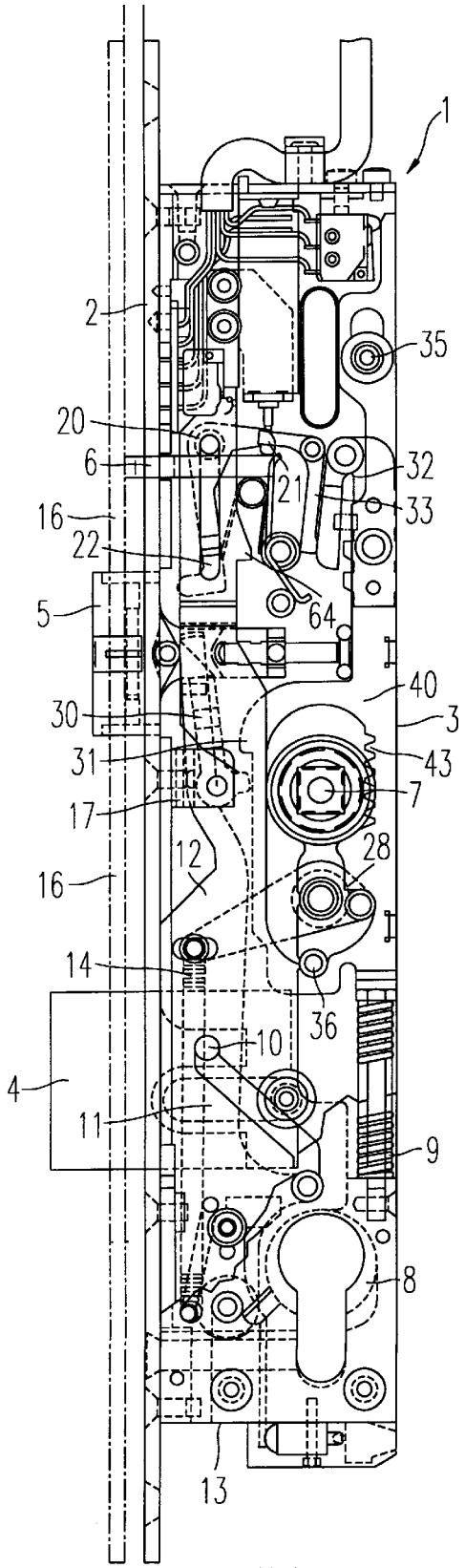
FIGS. 1 to 5 shown a side view of a lock with opened cover when in different lock actuation phases.

The safety lock shown in FIGS. 1 to 5 is a self-locking lock, which is constructed for a right-hand door, opening inwards and equipped with a panic function on the inside and freewheel function on the outside.

From the side views of this safety lock 1, it can be gathered that the entire lock mechanism and coupling device are so designed that an extremely narrow lock suitable for corresponding frame doors is provided.

The safety lock 1 according to FIGS. 1 to 5 has a lock face plate 2 and a housing 3, in which are adjustably arranged a bolt 4, a lock catch 5 and an auxiliary or control catch 6. The lock is operable by means of a two-part latch nut 7 and a key-operated lock cylinder 8.

The bolt 4 is constructed in such a way that there is an insurance regulations-relevant move out in locking position length of 20 mm. In the retracted position, i.e. in the lock open position, the bolt 4 extends close to compression springs 9 for resetting an inner/panic latch nut 26 and an outer/freewheel latch nut 27(cf. FIGS. 12 to 14).

The bolt 4 is guided with a recess 11 on a locking pin 10 and with the aid of a slide plate 12, which extends virtually from a lower housing edge 13 to beyond the auxiliary catch 6 in an upper area and is vertically adjustable against a tension spring 14. By means of a link-like guide 15 in the slide plate 12, in which the locking pin 10 is guided, in the case of a vertical adjustment of the slide plate 12, the bolt 4 is horizontally displaced from an open into a closed position and vice versa.

In FIG. 1 the lock 1 with the door closed is in the basic "door closed" position, in which the bolt 4 and the lock catch 5 located above it are moved forward in a locking position in openings of a locking plate 16 of a door frame. The auxiliary catch 6, located above the lock catch 5, is slid back somewhat and engages on the locking plate 16.

In the vicinity of the auxiliary catch 6, the slide plate 12 is provided with a vertical elongated hole 18 and is guided in a recess 37 of the auxiliary catch 6, the elongated hole 18 containing a bolt 19. The bolt 19 forms the pivot pin for a catch lever 20, which is constructed virtually at right angles and with an upper lever arm 21 arrests the auxiliary catch 6, while a lower lever arm 22 is in operative connection with the lock catch 5. In the vicinity of the lock catch 5, the slide plate 12 is provided with cams, which lock the lock catch 5 in the moved out in a locking position shown in FIG. 1. The bolt 4 is arrested by means of the link guide 15, where the locking bolt 10 is held in an end position.

If an inner latch (not shown) is depressed and an inner/panic nut 26 of the latch nut 7 rotated by approximately 35°, by means of meshing teeth 23 on the panic nut 26 and by means of teeth 43 of the panic rack 40, the latter is slid downwards. The panic rack 40 is connected by means of a cam 28 to a transport lever 29, which is guided on the slide plate 12, so that the latter and consequently the bolt 4 are also adjusted.

Both the lock catch 5 and the auxiliary catch 6 are spring-biased when moved out in a locking position. The lock catch 5 is connected by means of a catch lever 30, which is pivotably mounted in a housing-side holder 17 (FIGS. 2 and 3) to the panic rack 40 in the vicinity of a driver 31.

As the lock on the one hand ensures a locking of the door and only permits opening in the case of authorization, but an opening must also be ensured from one side in a panic case, below the panic rack 40 is provided a congruently constructed rack as a freewheel rack 41 (cf. also FIGS. 4 and 6 to 9). The panic rack 40 and freewheel rack 4L can be coupled with the aid of an armature plate 32 and an electromagnetically operable angle lever 33, to be described in detail in conjunction with FIGS. 5 to 9.

Figure 2:
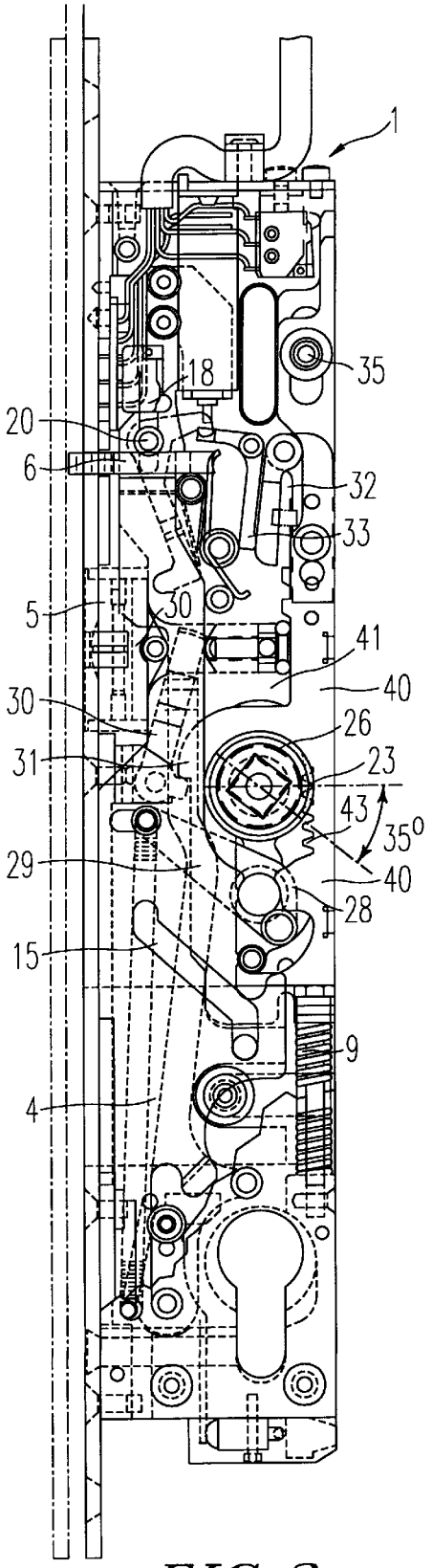

FIG. 2 shows the lock on actuation from the inside, i.e. in the panic function. Identical features are given identical reference numerals. Components unnecessary for the understanding of the invention are not provided with reference numerals.

On operating the inner or panic nut 26 by means of an inside, not shown door latch, the panic nut 26 is rotated by approximately 35°. The rotation is transformed by means of the meshing teeth 23 of the panic nut 26 and the teeth 43 of the panic rack 40 into a linear adjusting movement of the panic rack 40. By means of the cam 28 the transport lever 29 and the slide plate 12 are pivoted and by means of the driver 31 on the panic rack 40 the catch lever 30. Thus, bolt 4 and lock catch 5 are retracted into the housing 3 and the door can be opened. If the door is not opened and the door latch released, then the bolt 4 and lock catch 5 again move forward in the locking position and close the door in accordance with FIG. 1.

Figure 3:
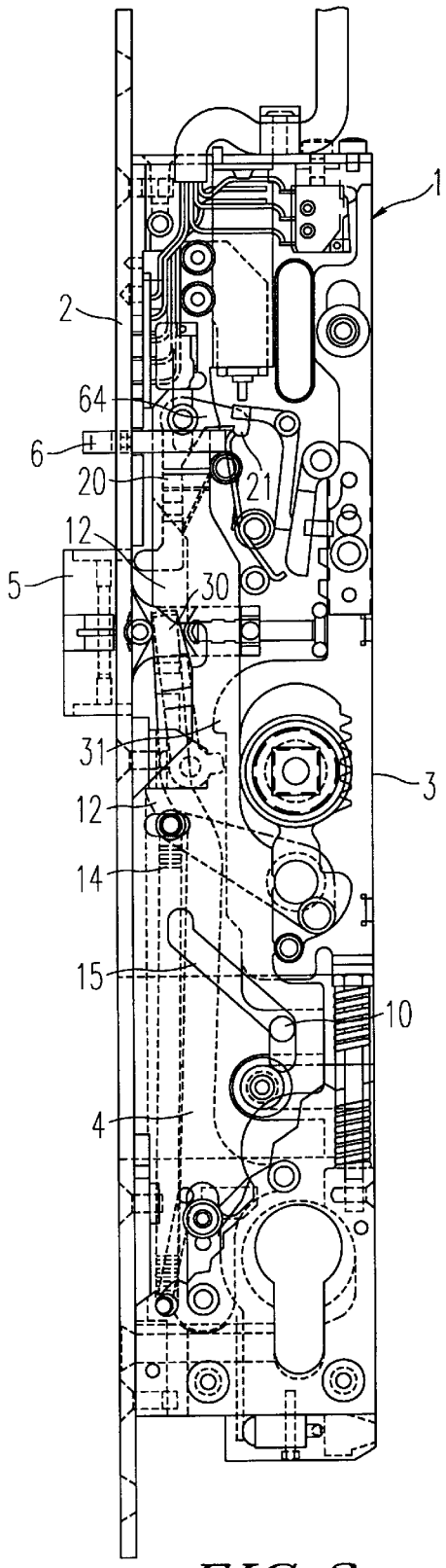

FIG. 3 shows the lock 1 with the door open. The auxiliary catch 6 and lock catch 5 project out of the lock face plate 2. The bolt 4 is retracted in the lock housing 3 and arrested against an unintentional moving forward in a locking position by the auxiliary catch 6, which is blocked by the upper lever arm 21 of the catch lever 20 and by means of a detent 64 arrests the slide plate 12. Through a relative movement of the lock catch 5 and auxiliary catch 6, the latter is unlocked by means of the catch lever 20. As a result of the downwardly adjusted slide plate 12, on closing the door the bolt 4 can be spring-loaded and moved forward in a locking position in self-locking manner (FIG. 4).

Figure 4:
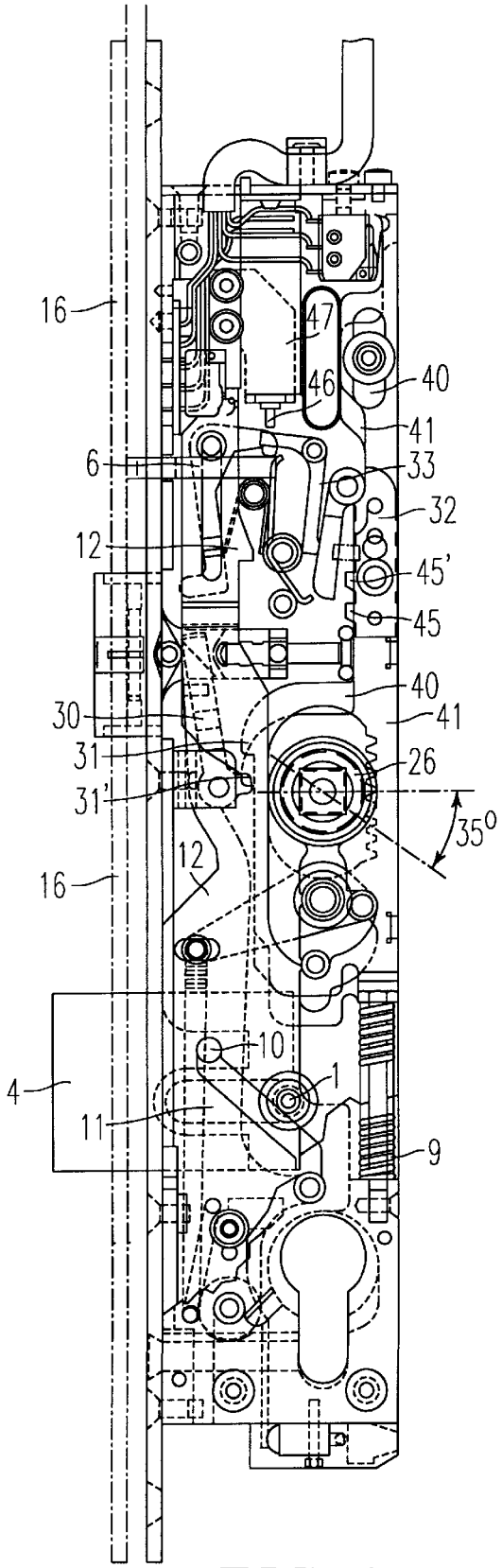

FIG. 4 shows an actuation from the outside with the door closed. No authorized access Exists, so that the freewheel latch nut 27, which is positioned below the panic latch nut 26, is decoupled. The not shown, outside door latch can then be pressed down to approximately 35°, but idles. The bolt 4 and lock catch 5 are not moved in the freewheel function and the lock 1 remains in the locked position.

Figure 5:
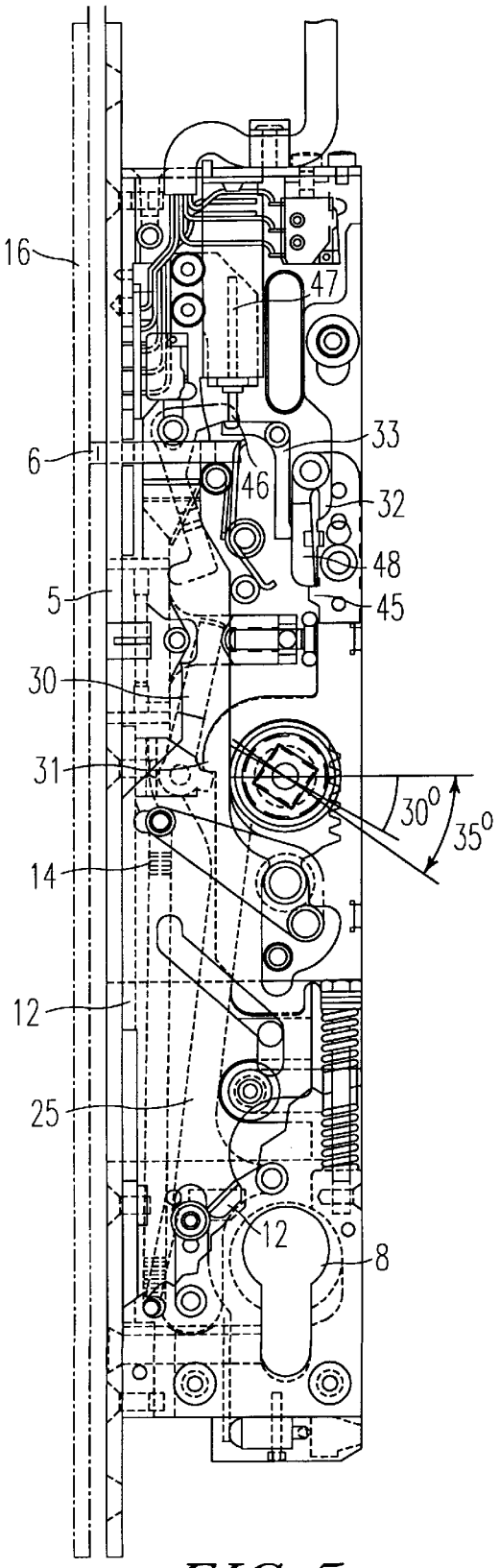

FIG. 5 shows the lock 1 on actuating the outer latch with authorized access, which can e.g. be implemented with an access control system. In the case of authorized access, an armature 46 of a lifting magnet 47 is extended and pivots the angle lever 33, which is in operative connection with the armature plate 32. The lifting magnet 47 is located in an upper area and the angle lever 33 between the superimposed racks 40, 41 and the auxiliary catch 6 or slide plate 12.

The actual coupling of the panic rack 40 and freewheel rack 41 takes place by means of a coupling member or detent 45 on the panic rack 40, in that the armature plate 32 with a coupling lever 48 jams on or engages behind the detent 45.

Through coupling the freewheel rack 41 to the panic rack 40, on pressing down the outer latch and rotating the outer/freewheel nut 27 by means of the meshing teeth 24, 44, the freewheel rack 41 and with it the coupled panic rack 40 is moved downwards. By means of the transport lever 29 and catch lever 30, which cooperate with the panic rack 40, the slide plate 12, bolt 4 and lock catch 5 are retracted into the housing, so that the door can be opened (cf. FIG. 2).

Not shown is an actuation of the lock with the key-actuatable lock cylinder 8, in which a locking nose retracts the slide plate 12 and bolt 4, as well as a changer 25 the lock catch 5 into the lock housing.

Figures 6, 7, 8, 9:
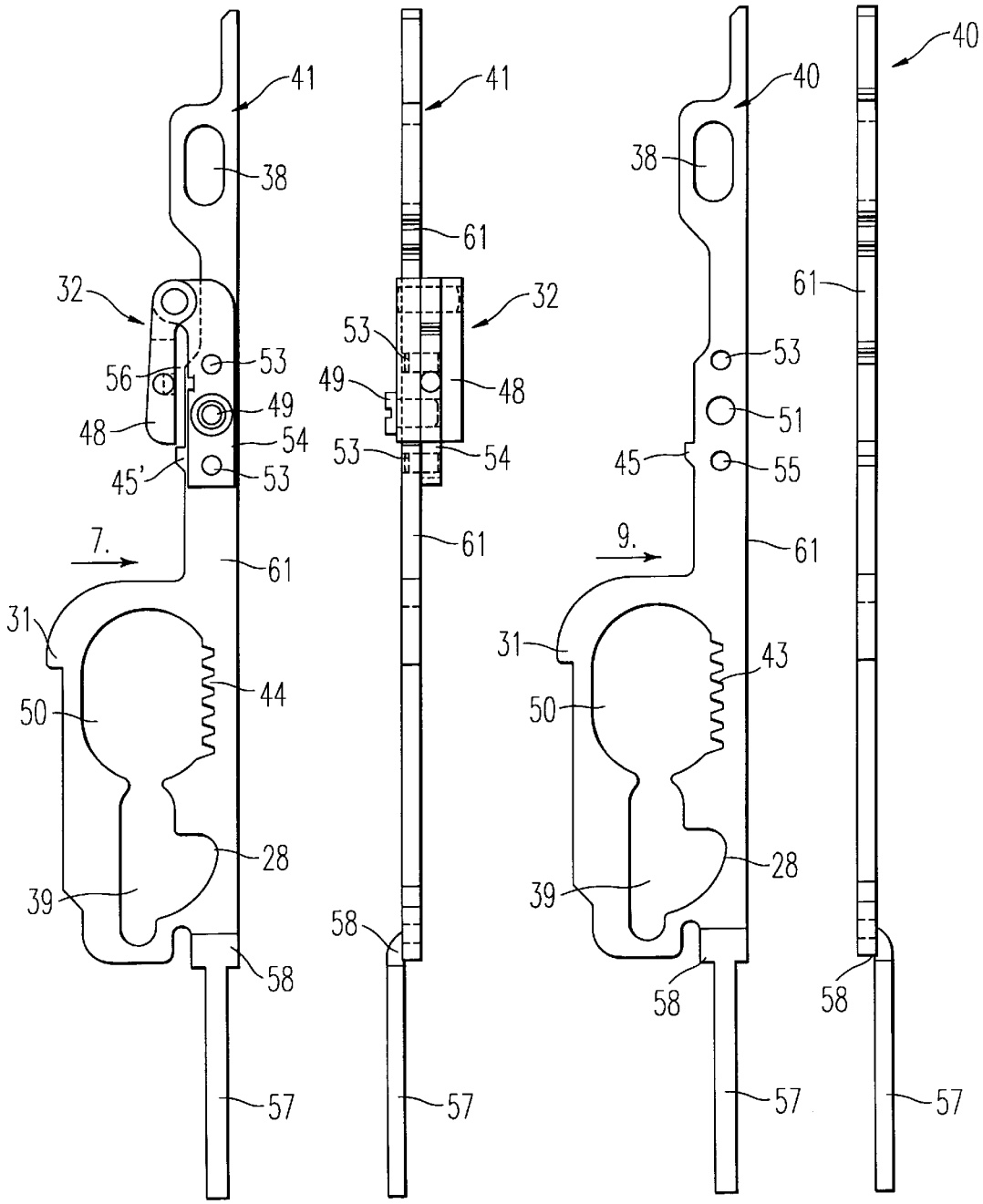
FIG. 6 shown a view of a complete rack (with armature plate) of the inventive coupling device.
FIG. 7 illustrates a side view of the rack taken along arrow VII in FIG. 6.
FIG. 8 shown a view of a rack of an inventive coupling device without an armature plate.
FIG. 9 illustrates a side view of an armature plate along arrow IX in FIG. 8.

FIGS. 6 and 7 show an outer or freewheel rack 41 with an armature plate 32 mounted therEon. This freewheel rack 41 is concealed in FIGS. 1, 3 and 5 by the superimposed, congruent panic rack 40 and is partly visible in FIGS. 2 and 4 in a position displaced with respect to the panic rack 40. The armature plate 32 of the complete rack 41 has a mounting flange 54 and the coupling lever 48, which is articulated to a horizontally positioned pivot pin 34 of the mounting flange 54.

Reference is made to FIG. 4 concerning the function of the armature plate 32, which reveals a decoupled and downwardly displaced freewheel rack 41. As the freewheel latch nut 27 has been rotated, but the armature plate 32 is not in coupling engagement with the detent 45 of the panic rack 40, the pressed down, outside, not shown door latch idles and the bolt 4 and catch 5 are not moved.

The complete freewheel rack 41 shown in FIGS. 6 and 7 is suitable for a self-locking lock, e.g. a right-hand door, opening inwards, or a left-hand door, opening outwards, both door designs having a panic function on the inside and freewheel function on the outside. The freewheel rack 41 can be held e.g. by means of fastening bolts 35, 36, which are fixed to the housing bottom (cf. FIG. 1).

FIGS. 8 and 9 show a congruent rack 40 with panic function, which cooperates with the complete rack 41 according to FIGS. 6 and 7. The same features of the racks 40, 41 are given the same reference numerals. Fastening bolts 35, 36, which are fixed to the housing bottom for the rack 41 according to figs. 6 and 7 and fastening bolts, which are fixed to the housing cover for the rack 40 according to figs.8 and 9, engage in each case in an upper recess 38 and lower recess 39 of the racks 40, 41. The recesses 38, 39 allow an adjustment according to the meshing teeth 23, 24 of the panic nut 26 and freewheel nut 27 or teeth 43, 44 of the panic rack 40 and freewheel rack 41. The teeth 43, 44 are constructed on an inside edge of a nut reception opening 50 of the racks 40, 41. The nut reception opening 50 passes into the lower recess 39, which is provided with the cam 28 for pivoting the transport lever 29 (cf. e.g. FIG. 1).

A coupling of the freewheel rack 41 according to FIGS. 6 and 7 or of the panic rack 40 according to FIGS. 8 and 9 takes place by means of the armature plate 32 and its angle lever 48. The armature plate 32 can be fixed to each rack 40, 41 and subject to the panic or freewheel function, to the side directed towards the lock cover or the side directed towards the housing bottom of the particular rack.

Figure 10:
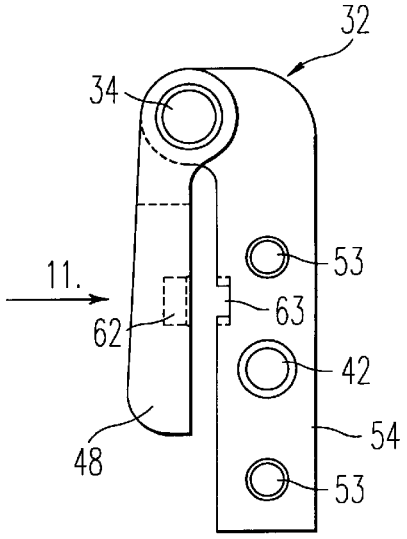
FIG. 10 shown a larger scale view of an armature plate of an inventive coupling device according to FIG. 6.
Figure 11:
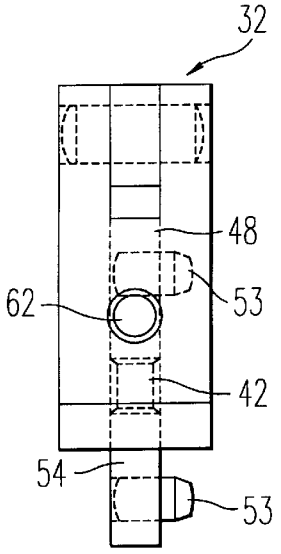
FIG. 11 shown a side view of an armature plate taken along arrow XI in FIG. 10.

Fixing takes place with a cylinder screw 49, which is screwed in aligned openings 51, 52 of the rack 40, 41 (cf. FIG. 8) or mounting flange 54 of the armature plate 32 (cf. FIGS. 10 and 11). Cylinder pins 53 on the mounting flange 54 of the armature plate 32 engage in complimentary openings 55 of the racks 40, 41. The coupling lever 48 is pivotably articulated to the mounting flange 54 of the armature plate 32 and spread out so far with the aid of a compression spring 56 received in recesses 62, 63 of the mounting flange 54 and coupling lever 33, that in the unenergized state of the lifting magnet 47, the coupling lever 48 does not engage in the detent 45 of the panic rack 40 (cf. e.g. FIG. 1).

The panic rack 40 and freewheel rack 41 of FIGS. 6 to 9 have a lower rack area 57 for receiving a compression spring 9 (cf. FIGS. 1 to 5), which is therefore offset with respect to the upper rack area. The compression springs 9 are in each case supported on the housing side and against a shoulder 58 of the racks 40, 41.

FIGS. 10 and 11 show an armature plate 32 in a larger scale view. Compared with the armature plate 32 mounted on a freewheel rack 41 in FIGS. 6 and 7, the armature plates 32 differ only through the installation side, i.e. the orientation of the cylinder pins 53. FIG. 11 mikes it clear that the coupling lever 48 projects on either side over the mounting flange 54 and can cooperate, as desired, with the coupling nose or detent 45 of a rack 40, 41 arranged to the right or left of the mounting flange 54. A decoupled position of the coupling lever 48 is reached by a not shown compression spring received in the recesses 62, 63.

Figure 12:
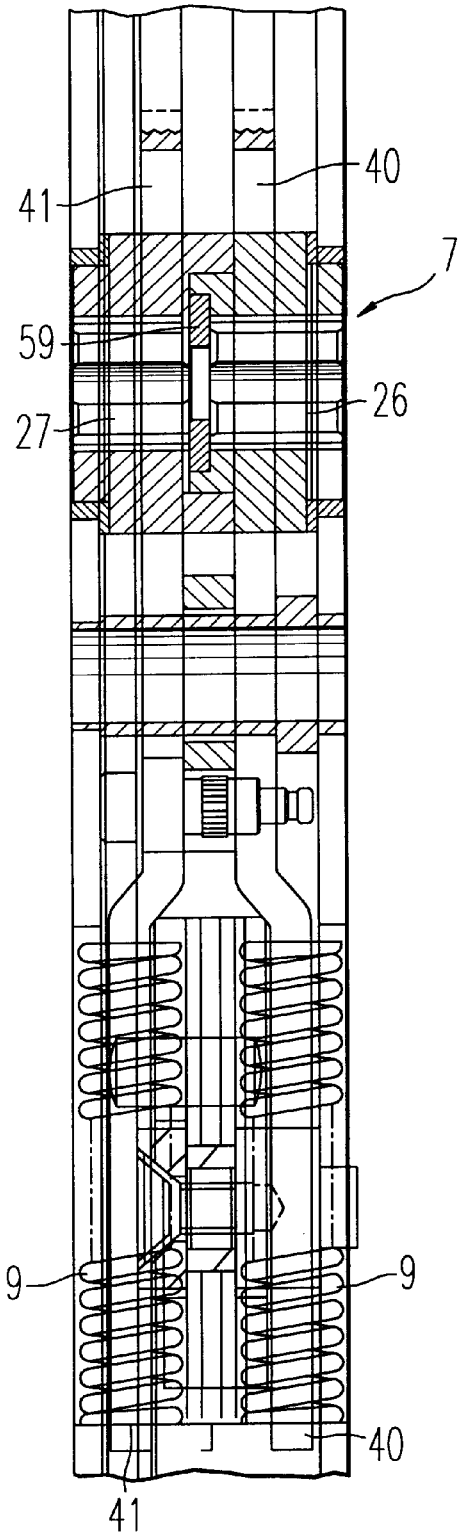
FIG. 12 illustrates a longitudinal section of an inventive safety lock parallel to the lock face plate and in the area of the racks and split latch nut.
Figure 13:
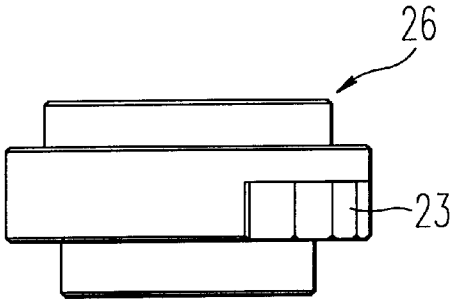
FIGS. 13/14 Side views of a panic and freewheel nut.
Figure 14:
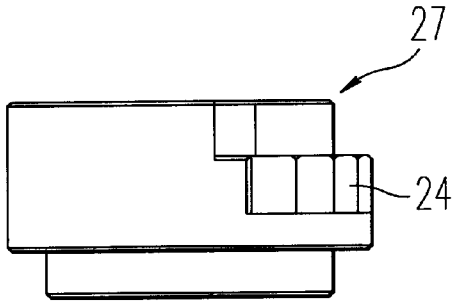

FIGS. 12 to 14 show the construction of an inner/panic nut 26 and an outer/freewheel nut 27. FIG. 12 shows in detail form a face plate-side view of a safety lock in the area of the superimposed racks 40, 41 and a two-part latch nut 7.

The split latch nut 7 comprises the inner/panic nut 26 and the outer/free-wheel nut 27 separated from one another by a disk 59. FIG. 12 illustrates the space-saving arrangement of the compression springs 9 on the lower rack areas 57 of the racks 40, 41, which are bent in opposition to one another.

FIGS. 13 and 14 show a panic nut 26 with teeth 23 and a freewheel nut 27 with teeth 24. The teeth 23, 24 are only constructed in a curve area of approximately 45°, which can be gathered from the plan views of FIGS. 1 to 5 of the panic nut 26. The latch nut halves 26, 27 and racks 40, 41 can have the same number of teeth, so as to in each case obtain the necessary adjustment of the racks 40, 41 through a pivoting of the particular latch nut half 26, 27.

What we claim is:

1. A safety lock with at least one lock catch and a bolt, which comprises:

a lock cylinder and a split latch nut, the split latch nut having an inner nut with a panic function and an outer nut with a freewheel function;

first and second racks, said first rack comprising one of an inner rack and a panic rack engaging with the inner nut and said second rack comprising one of an outer rack and a freewheel rack engaging with the outer nut via meshing teeth;

an electromagnetic coupling device for coupling the inner nut and the outer nut, said electromagnetic coupling device including said inner rack and said outer rack; and a coupling lever fixed to one of said first and second racks and providing coupling engagement with the other rack of said first and second racks;

wherein the racks are arranged with flat sides thereof each in engagement for use as said panic rack or said freewheel rack; and wherein one of said panic rack and said freewheel rack have a congruent construction and is coupleable by said armature plate.

2. A safety lock with at least one lock catch and a bolt, which comprises:

a lock cylinder and a split latch nut, the split latch nut having an inner nut with a panic function and an outer nut with a freewheel function;

first and second racks, said first rack comprising one of an inner rack and a panic rack engaging with the inner nut and said second rack comprising one of an outer rack and a freewheel rack engaging with the outer nut via meshing teeth;

an electromagnetic coupling device for coupling the inner nut and the outer nut, said electromagnetic coupling device including said inner rack and said outer rack; and a coupling lever fixed to one of said first and second racks and providing coupling engagement with the other rack of said first and second racks;

wherein the racks are arranged with flat sides thereof each in engagement for use as said panic rack or said freewheel rack; and wherein the panic rack and freewheel rack, at least in the vicinity of the inner and outer nut, are provided with a nut reception opening, in which are positioned the teeth of the panic rack and the teeth of the freewheel rack and which mesh with the teeth of the inner and outer nuts.

3. Safety lock according to claim 1, wherein the teeth of the inner and outer nuts are locked on a circumferential area forming an angle of approximately 45°.

4. Safety lock according to claim 1, wherein the panic rack and freewheel rack are vertically adjustable against the tension of a compression spring, which is provided on or around a lower rack area.

5. Safety lock according to claim 1, wherein the coupling lever is electromagnetically adjustable and engageable with a detent on the rack to be coupled and is provided on the armature plate, which is fixable to the rack to be coupled.

6. Safety lock according to claim 5, wherein the armature plate has a mounting flange fixable to one of a top portion and a bottom portion of said rack to be coupled, said mounting flange having a pivot pin positioned thereon wherein the coupling lever is articulated about said pivot pin and, in a mounted state, projects over lateral edges of the panic rack and the freewheel rack and, in the coupling position, locks on detent portions thereof.

7. Safety lock according to claim 4, wherein the nut reception opening of the panic and freewheel racks is adapted to the diameter of the panic and freewheel nut and an adjustment path of the panic and freewheel racks.

8. Safety lock according to claim 1, wherein at least one of the panic and freewheel racks have a driver and a cam, which directly or indirectly adjust the bolt or the lock catch.

9. Safety lock according to claim 8, which comprises a transport lever wherein the panic rack has the driver and the cam and wherein the driver of the panic rack is connected to a catch lever and the cam is connected with said transport lever in the vicinity of a lower recess.

10. Safety lock according to claim 1, wherein the lock comprises a self-locking lock.

11. Safety lock according to claim 1, wherein the lock comprises a tubular frame lock.

* * * * *